US008104630B2

(12) United States Patent
Schneider

(10) Patent No.: US 8,104,630 B2
(45) Date of Patent: Jan. 31, 2012

(54) SHELF DIVIDER

(75) Inventor: Raymond M. Schneider, Port Washington, NY (US)

(73) Assignee: Display Technologies, College, Point, NY (US)

( * ) Notice: Subject to any disclaimer, the term of this patent is extended or adjusted under 35 U.S.C. 154(b) by 897 days.

(21) Appl. No.: 11/656,730

(22) Filed: Jan. 23, 2007

(65) Prior Publication Data

US 2007/0175844 A1 Aug. 2, 2007

Related U.S. Application Data

(60) Provisional application No. 60/762,983, filed on Jan. 27, 2006.

(51) Int. Cl.
*A47F 5/00* (2006.01)

(52) U.S. Cl. ..... 211/184

(58) Field of Classification Search ..... 211/59.2, 211/184, 59.3, 59.4, 133.5; 108/60, 61; 206/524, 206/561; 248/225.21, 235; 312/35
See application file for complete search history.

(56) References Cited

U.S. PATENT DOCUMENTS

| | | | | | |
|---|---|---|---|---|---|
| 2,280,371 | A * | 4/1942 | Bishop | 211/184 |
| 2,308,629 | A * | 1/1943 | Rosenberg | 211/131.1 |
| 3,145,850 | A * | 8/1964 | Ciborowski | 211/133.5 |
| 3,367,510 | A * | 2/1968 | Krikorian | 211/133.5 |
| 3,497,081 | A * | 2/1970 | Field | 211/184 |
| 3,501,019 | A * | 3/1970 | Armstrong et al. | 211/184 |
| 3,559,815 | A * | 2/1971 | Huddleston | 211/184 |
| 3,703,964 | A * | 11/1972 | Field | 211/184 |
| 3,739,918 | A * | 6/1973 | Kreitzburg | 211/44 |
| 3,872,976 | A * | 3/1975 | Moore et al. | 211/184 |
| 4,023,682 | A * | 5/1977 | Niece | 211/184 |
| 5,082,125 | A * | 1/1992 | Ninni | 211/184 |
| 6,234,328 | B1 * | 5/2001 | Mason | 211/90.02 |
| 6,402,106 | B1 * | 6/2002 | Padiak | 248/221.11 |
| 7,097,052 | B2 * | 8/2006 | Lau | 211/184 |
| 7,182,209 | B2 * | 2/2007 | Squitieri | 211/59.2 |
| 2003/0010737 | A1 * | 1/2003 | Lee | 211/184 |
| 2003/0132178 | A1 * | 7/2003 | Jay et al. | 211/59.2 |
| 2005/0133471 | A1 * | 6/2005 | Squitieri | 211/59.2 |

* cited by examiner

*Primary Examiner* — Darnell Jayne
*Assistant Examiner* — Joshua Rodden
(74) *Attorney, Agent, or Firm* — Carter, DeLuca, Farrell & Schmidt, LLP

(57) ABSTRACT

A display apparatus for holding a plurality of items and including a base and at least one shelf divider is disclosed. The base includes a front end, a back end, a left end, a right end, and an upper surface for supporting the items. The shelf divider is removably installable on the base and defines at least one channel dimensioned for accommodating an associated column of the items. The shelf divider includes a top surface, a bottom surface, a front edge, a rear edge and at least one compliant member depending from the bottom surface. The compliant member is deflectable towards the top surface upon engagement with a portion of the base.

7 Claims, 4 Drawing Sheets

SHELF DIVIDER

CROSS REFERENCE TO RELATED APPLICATIONS

The present application claims the benefit and priority of provisional application Ser. No. 60/762,983 filed on Jan. 27, 2006 and titled REMOVABLE STABILIZED DIVIDER, by Raymond M. Schneider. The entire contents of this application are hereby incorporated in its entirety herein.

BACKGROUND

The present disclosure relates to a shelf divider for use on a display apparatus, and more particularly, to a shelf divider with structure to enhance the stability of the shelf divider on a base.

There are a wide variety of devices for storing, displaying, and dispensing items or products such as individual beverage containers. A broad genus of such devices are known as glides. The use of glides and shelf dividers often confine the items to discrete lanes (often designated rows or columns), typically arrayed extending front-to-back in a refrigerator, display case, or shelf unit. Many such glides are configured or mounted so the glide base surface supporting the items inclines from front to back to allow a back-to-front gravity feed.

Shelf dividers may be removably secured to the glides at various locations along the glide base, to create lanes of different widths, for example. Structure on the base and/or on the shelf divider itself may help maintain the shelf divider in a desired location on the base.

Items are often loaded onto the glide from the front portion of the glide base, i.e., front-loading. During this loading or stocking process, the shelf dividers are commonly contacted by the items. A corner of the shelf divider, for example, may snag a portion of an item and slow the loading process. Further, the impact from the item hitting the shelf divider may cause the shelf divider to become dislodged from its desired position.

Thus, it would be desirable to provide a display apparatus having a shelf divider with structure to enhance the stability of the shelf divider on the base.

SUMMARY

The present disclosure relates to a display apparatus for holding a plurality of items and includes a base and at least one shelf divider. The base includes a front end, a back end, a left end, a right end, and an upper surface for supporting the items. The shelf divider is removably installable on the base to define at least one channel dimensioned for accommodating an associated column of the items. The shelf divider includes a top surface, a bottom surface, a front edge, a rear edge at least one compliant member depending from the bottom surface. The compliant member is deflectable towards the top surface upon engagement with a portion of the base.

The present disclosure also relates to a shelf divider for use with a base. The shelf divider includes a body portion and at least one compliant member. The body portion includes a top surface, a bottom surface, a front edge and a rear edge. The compliant member depends from the bottom surface and is deflectable towards the top surface. The shelf divider is installable on the base and the compliant member helps stabilize the shelf portion in a desired position.

In an embodiment of the disclosure, a transition between the front edge and the top surface of the shelf divider includes a radius.

DETAILED DESCRIPTION

Figure 1:
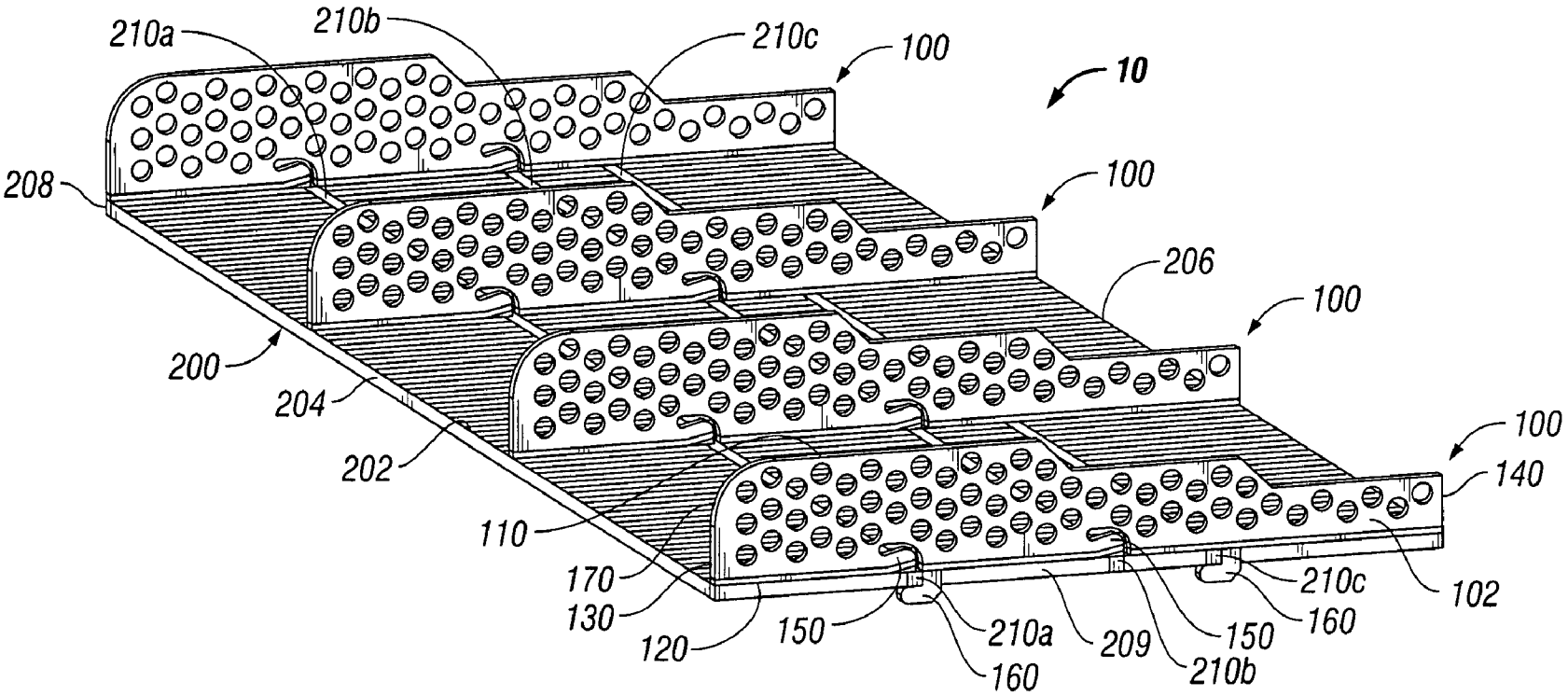
FIG. 1 illustrates a perspective view of a display apparatus in accordance with an embodiment of the present disclosure.

Embodiments of the presently disclosed shelf divider and display apparatus are now described in detail with reference to the drawings, in which like reference numerals designate identical or corresponding elements in each of the several views. As used herein the term "distal" refers to that portion of the display apparatus, or component thereof, farther from the user, while the term "proximal" refers to that portion of the display apparatus, or component thereof, closer to the user.

Various embodiment of a shelf divider are illustrated in FIGS. 1-5 and are generally referenced by numeral 100. Shelf divider 100 is configured to be removably installable on a base 200 and includes a body portion 102 having a top surface 110, a bottom surface 120, a front edge 130, a rear edge 140 and a compliant member 150. More specifically, compliant member 150 is configured to engage a rail 210 of base 200 to help maintain shelf divider 100 in a desired position. Base 200 includes an upper surface 202 for supporting items, a front end 204, a back end 206, a left end 208 and a right end 209 (see FIG. 1).

FIG. 1 illustrates a display apparatus 10, showing four shelf dividers 100 installed on base 200. Display apparatus 10 is illustrated with three side-by-side channels, each having a width and length effective to accommodate an associated front-to-back column of items. It is envisioned that more or fewer shelf dividers 100 are included with display apparatus 10, thus creating more or fewer lanes. Further, more than one base 200 may also be included.

With continued reference to FIG. 1, two compliant members 150 are shown on each shelf divider 100 and are configured to help maintain shelf divider 100 in a desired position relative to base 200. In the illustrated embodiments, each compliant member 150 is positioned to engage a rail 210 of base 200. In a contemplated embodiment, compliant members 150 are configured to exert a downward force on rail 210 to help stabilize shelf divider 100 (e.g., in response to an external force). For example, when items are loaded onto the display apparatus from the front (i.e., front-loaded), it is not uncommon for an item to contact front edge 130 of shelf divider 100.

Two hooks 160 are also shown on each shelf divider 100 of FIG. 1. Each hook 160 depends from bottom surface 120 of shelf divider 100 and is configured to engage a rail 210 of base 200. As shown in FIG. 1, compliant member 150 and hook 160 may be configured to engage the same rail 210*a* or different rails 210*b* and 210*c*.

Figure 2:
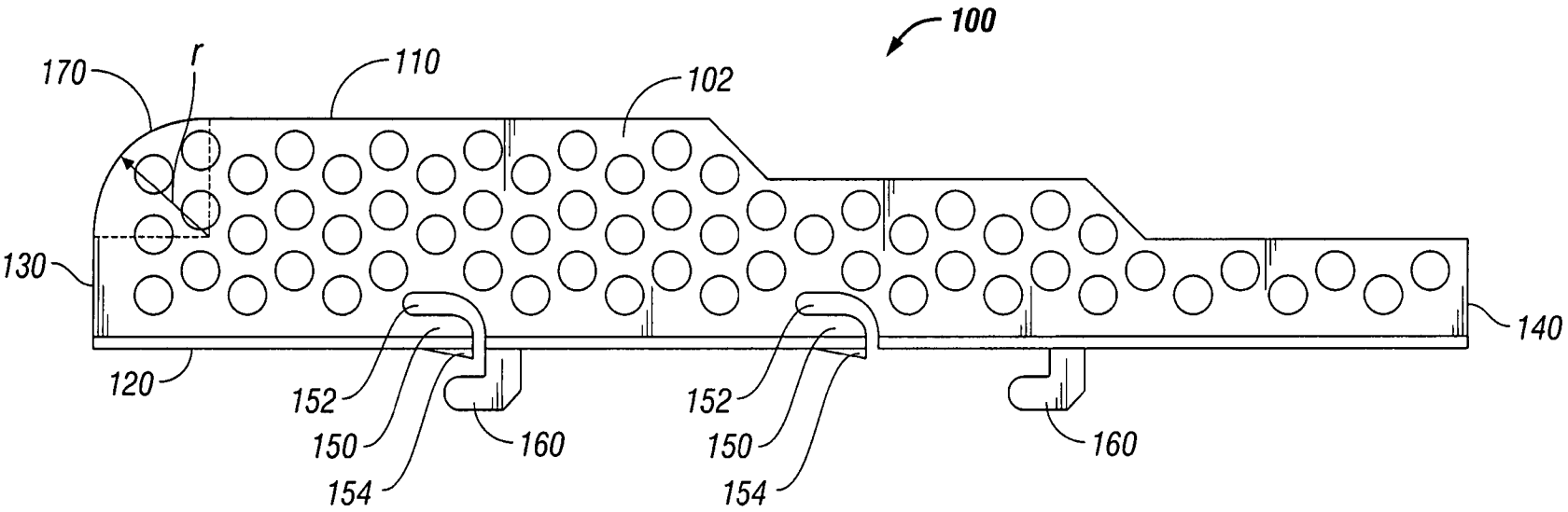
FIG. 2 illustrates a side view of a shelf divider of FIG. 1 in accordance with an embodiment of the present disclosure.
Figure 3:
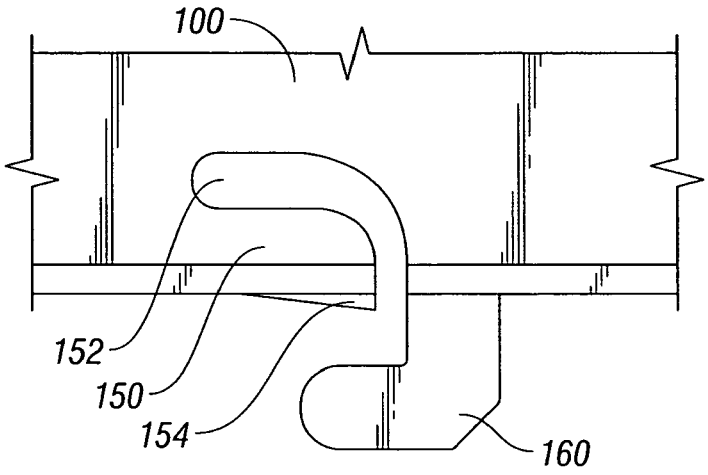
FIG. 3 illustrates an enlarged portion of a compliant member of the shelf divider of FIGS. 1 and 2 in accordance with an embodiment of the present disclosure.
Figure 4:
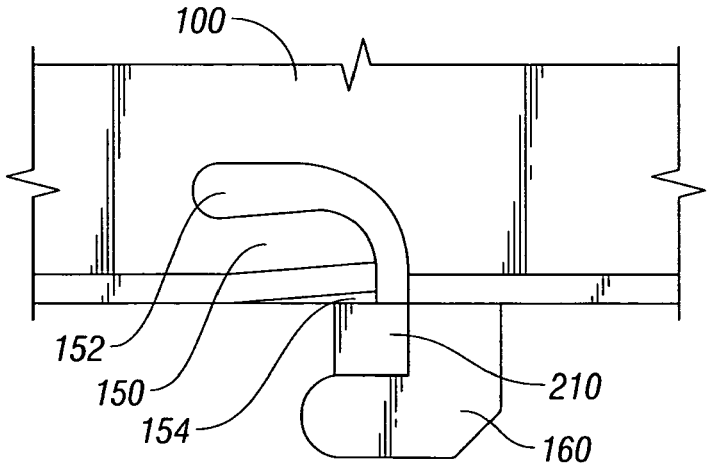
FIG. 4 illustrates the compliant member of FIG. 3 engaged with a portion of a base.

A single shelf divider 100 is shown in FIG. 2 and compliant member 150 is shown in detail in FIGS. 3 and 4. In FIG. 3, compliant member 150 is shown depending from bottom surface 120 of shelf divider 100 and adjacent hook 160. An open space, or void 152, is disposed within shelf divider 100 and adjacent compliant member 150. Void 152 allows compliant member 150 to be deflected in the general direction of void 152. As such, FIG. 4 illustrates compliant member 150 engaged with rail 210 and deflected upwards and partially into void 152. FIG. 4 also shows hook 160 of shelf divider 100 engaged with rail 210. It is envisioned that compliant member 150 is downwardly-biased (away from top surface 110) and includes a ramp 154 thereon.

When comparing FIGS. 3 and 4, the deflection of compliant member 150 is evident. As can be appreciated, the downward pressure exerted by compliant member 150 on rail 210 helps maintain shelf divider 100 in a desired position with respect to rail 210 and base 200.

Figure 5:
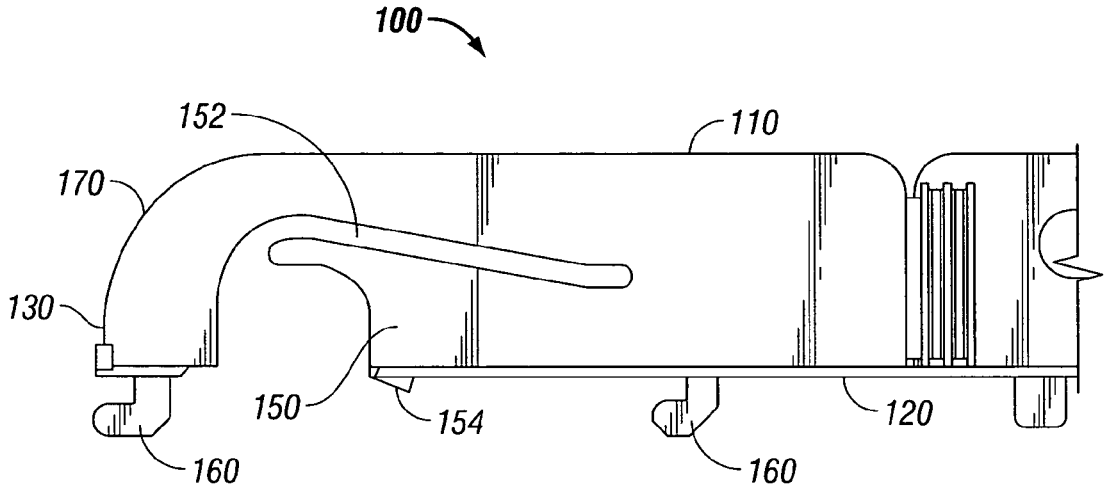
FIG. 5 illustrate a side view of a shelf divider in accordance with an embodiment of the present disclosure.

As illustrated in an embodiment of shelf divider 100 in FIG. 5, the shape and size of compliant member 150 and void 152 are not limited to the illustrated embodiments of FIGS. 1-4. Additionally, other embodiments of shelf divider 100, compliant member 150 and void 152 are contemplated by the present disclosure.

Referring to FIGS. 1, 2, and 5, a transition 170 between top surface 110 and front edge 130 of shelf divider 100 is shown. In the illustrated embodiments, transition 170 includes a rounded surface having a radius r (FIG. 2). In an envisioned embodiment, radius r is between about 0.0625 inches and about 3 inches. Such a transition 170 helps ensure that items do not get snagged or caught on a corner of shelf divider 100 when being front-loaded While a rounded transition 170 is shown, it is envisioned that the cross-section of transition 170 includes any portion of a regular or irregular shape, such as an ogee, for example.

It is further envisioned that transition 170 (e.g., the radiused edge thereof) helps dissipate the impact from an item that contacts shelf divider 100 vis-à-vis a shelf divider having a corner or a squared transition 170. Therefore, it is envisioned that fewer external forces will be acting on shelf divider 100. Consequently, transition 170 may further help maintain shelf divider 100 in a desired position on base 200.

As mentioned above, shelf divider 100 is removably installable on base 200. To install shelf divider 100 in accordance with a disclosed embodiment, a user positions shelf divider 100 in a desired left-to-right location with respect to base 200. Shelf divider 100 is then placed such that each compliant member 150 (and/or hook 160) is positioned distally of a corresponding rail 210 of base 200. Further, bottom surface 120 of shelf divider 100 is positioned in contact or substantial contact with upper surface 202 of base 200. Once appropriately positioned, shelf divider 100 is moved proximally. Upon proximal movement of shelf divider 100, a portion of compliant member 150 (e.g., ramp 154) contacts rail 210. Compliant member 150 then deflects at least partially into void 152 (towards upper surface 110).

In an embodiment, compliant member 150 is downwardly-biased (e.g., towards rail the 210 in contact therewith), thus helping secure shelf divider 100 in place with respect to base 200. Additionally, in the embodiments including at least one hook 160, proximal movement of shelf divider 100 causes hook 160 to engage rail 210 and further secures shelf divider 100 in place.

It is also envisioned that ramp 154 of compliant member 150 and/or hook 160 are facing rear edge 140 of shelf divider 100. In such an embodiment, compliant member 150 and/or hook 160 of shelf divider 100 may be positioned proximally of a corresponding rail and moved distally into a desired position. Thus, the installation details discussed above are not limited to what is described.

It will be understood that various modifications may be made to the embodiments disclosed herein. For example, it is contemplated that shelf divider 100, compliant member 150 and/or hook 160 can be a variety of shapes and sizes and is not limited to the illustrated embodiments. Further, a plurality of round holes are shown through body portion 102 of shelf divider 100 (to decrease its weight, for example), but holes of other shapes and sizes are also envisioned, including no holes. Therefore, the above description should not be construed as limiting, but merely as exemplifications of various embodiments. Those skilled in the art will envision other modifications within the scope and spirit of the claims appended hereto.

What is claimed:

1. A display apparatus for holding a plurality of items, comprising:

a base including a front end, a back end, a left end, a right end, an upper surface for supporting items, and a rail extending between the right end and the left end of the base; and at least one shelf divider removably installable on the base to define at least one channel, the channel dimensioned for accommodating an associated column of items and the shelf divider including a body portion, a top surface, a bottom surface, a front edge, a rear edge, and at least one compliant member disposed in mechanical engagement with the bottom surface, the at least one compliant member being deflectable towards the top surface upon engagement with the rail of the base, the compliant member defining a cantilever structure having a forward portion integrally formed with the body portion and a rear bendable portion, wherein the rear bendable portion is distal of the forward portion and the front edge of the body portion; at least one hook depending from the bottom surface of the shelf divider, the at least one hook configured to engage the rail of the base such that the rail of the base is simultaneously engaged therewith and with the rear bendable portion to maintain the shelf divider in a desired position.

2. The display apparatus of claim 1, wherein the compliant member is biased away from the top surface of the shelf divider.

3. The display apparatus of claim 1, further including a void disposed adjacent the compliant member.

4. The display apparatus of claim 1, wherein a transition between the front edge and the top surface includes a radius r.

5. The display apparatus of claim 4, wherein the radius r is between about 0.0625 inches and about 3 inches.

6. The display apparatus of claim 1, wherein a transition between the front edge and the top surface includes a radius r and wherein the radius r is between about 0.0625 inches and about 3 inches.

7. The display apparatus of claim 1, wherein the compliant member is deflectable towards the top surface of the shelf divider upon engagement with the rail.

* * * * *